US006185975B1

(12) United States Patent
Nicoletti

(10) Patent No.: US 6,185,975 B1
(45) Date of Patent: Feb. 13, 2001

(54) APPARATUS FOR COLD BENDING OF METAL SHEETS FOR MAKING ELONGATED ARTICLES WITH PREDETERMINED PROFILE

(75) Inventor: Bruno Nicoletti, Calderino Di Monte S. Pietro (IT)

(73) Assignee: Metal Work S.r.l., Calderino Di Monte S. Pietro (IT)

( * ) Notice: Under 35 U.S.C. 154(b), the term of this patent shall be extended for 0 days.

(21) Appl. No.: 09/370,613

(22) Filed: Aug. 7, 1999

(51) Int. Cl.[7] ..... B21D 5/04; B21D 5/16
(52) U.S. Cl. ..... 72/306; 72/311; 72/383
(58) Field of Search ..... 72/306, 311, 312, 72/296, 297, 381–383, 420

(56) References Cited

U.S. PATENT DOCUMENTS

| | | | | |
|---|---|---|---|---|
| 1,552,416 | * | 9/1925 | Bingham | 72/383 |
| 2,286,255 | * | 6/1942 | Brooks | 72/383 |
| 2,557,346 | * | 6/1951 | Green | 72/306 |
| 2,765,020 | * | 10/1956 | Scarlett | 72/306 |
| 3,595,061 | * | 7/1971 | Bassbo | 72/381 |
| 3,927,548 | * | 12/1975 | Lannin | 72/382 |
| 4,893,463 | * | 1/1990 | Woolford | 72/381 |
| 5,572,901 | * | 11/1996 | Wilhelm | 72/420 |

FOREIGN PATENT DOCUMENTS

| | | | | |
|---|---|---|---|---|
| 1792770 | * | 2/1993 | (RU) | 72/383 |

* cited by examiner

*Primary Examiner*—Daniel C. Crane
(74) *Attorney, Agent, or Firm*—William J. Sapone; Coleman Sudol Sapone, P.C.

(57) ABSTRACT

In an apparatus for cold bending a metal sheet for making an elongated article with a predetermined pro-file, supports are provided to receive opposite ends of the sheet being formed. A form, whose cross section defines a predetermined profile, is operated perpendicularly with respect to its longitudinal axis, so as to clamp the sheet, resting on the supports, to a stop. Bending members are carried by two plates which are mounted for oscillating on a vertical plane transversal to the form, so that the bending members rotate around spindles parallel to the stop plate. The bending members are operated in time relation with a synchronous movement of the form and of the stop, so as to fold the two ends of the sheet piece over the form.

7 Claims, 7 Drawing Sheets

FIG.4b
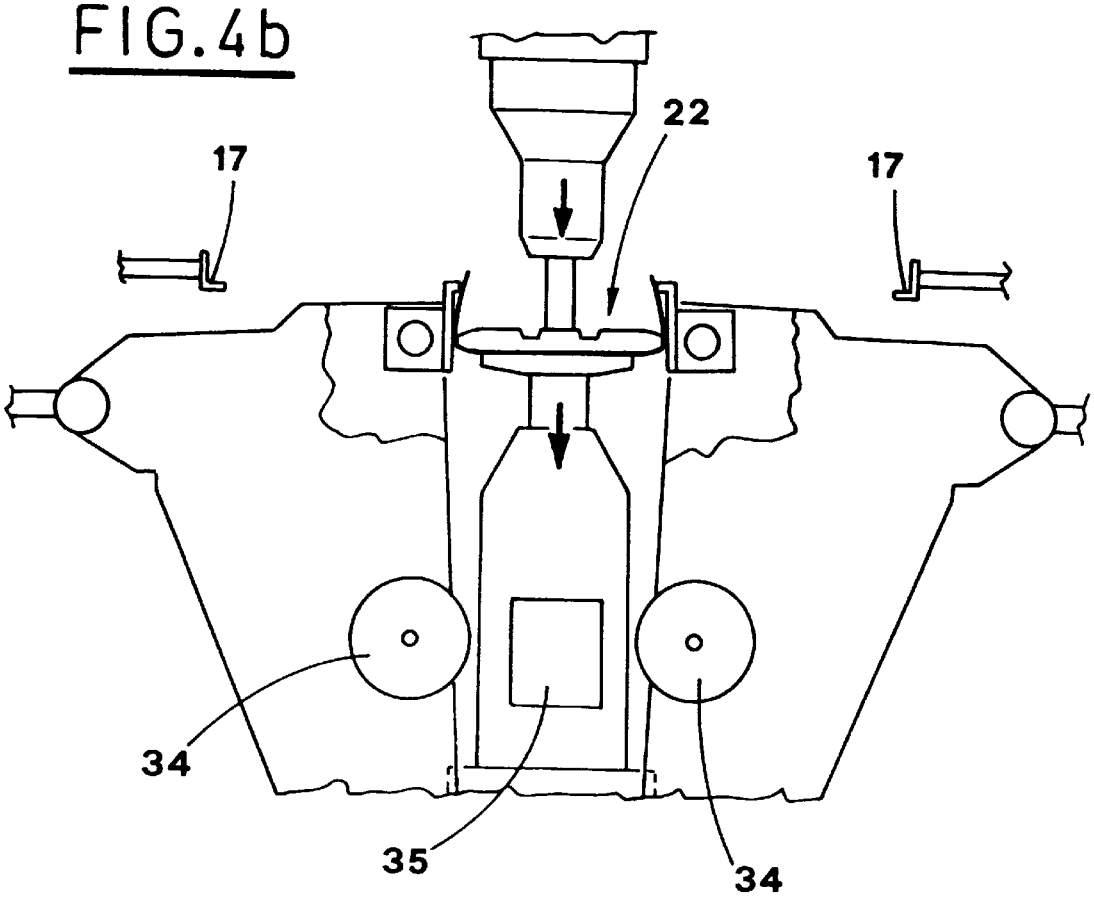
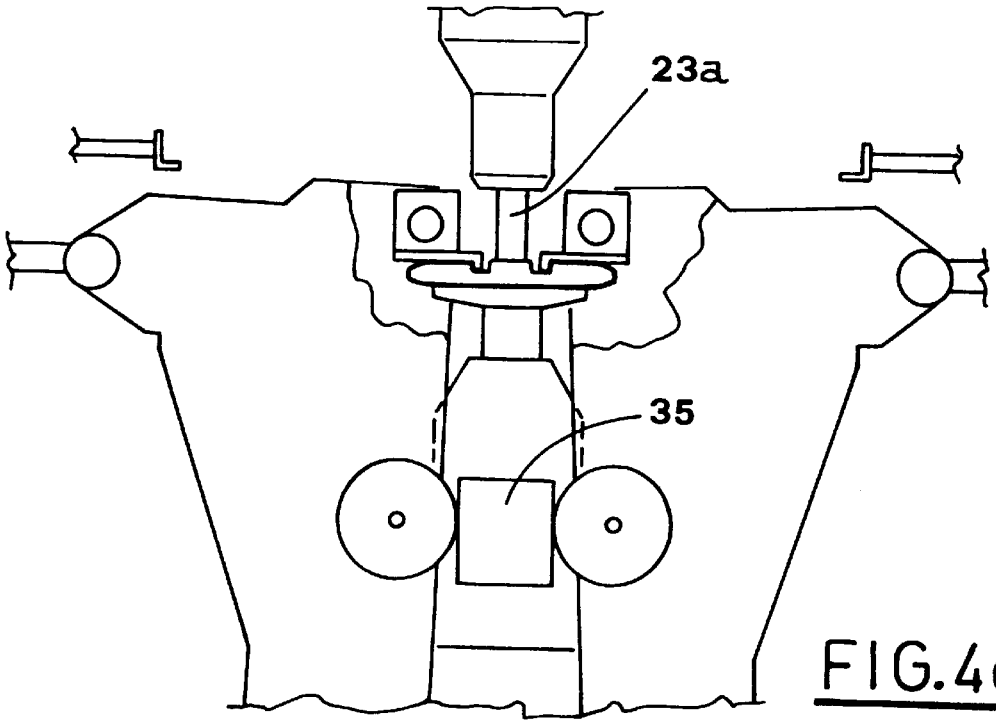
FIG.4c

APPARATUS FOR COLD BENDING OF METAL SHEETS FOR MAKING ELONGATED ARTICLES WITH PREDETERMINED PROFILE

FIELD OF THE INVENTION

The present invention relates to production of elongated articles with predetermined section profile.

In particular, the present invention refers to an apparatus for cold bending of metal sheets for making elongated articles with predetermined profile.

DESCRIPTION OF THE PRIOR ART

There is known a need to produce elongated articles with predetermined profile from sheets of metal.

Elongated articles of this kind are usually used e.g. for covering some particulars of furniture or the like.

FIG. 1 shows an example of an article of the above mentioned type, indicated with 1.

This article 1 is substantially formed of a sheet of metal, of length L, whose longitudinal edges 2 are folded so as to form a "C" shape with the edges 3 turned inward.

The front surface 4 of the article 1 has longitudinal ribs 5 and transversal ribs 6, obtained by deep drawing of the sheet of metal.

At present, the elongated articles of the type illustrated in FIG. 1 are produced from a continuous section obtained from a sheet of metal.

This section is cut according to the length of the articles to be produced.

This requires big, in particular very long apparatuses for folding the sheet of metal until the predetermined profile is obtained.

The above mentioned apparatuses generally do not allow to produce special relieves, such as the above mentioned ribs or the like.

Therefore, these relieves must be done separately, by a special deep drawing operation.

Moreover, these apparatuses are not very flexible, and consequently, a change of production requires the substitution of many elements and causes long breaks in the machine operation which results in productivity reduction.

SUMMARY OF THE INVENTION

The object of the present invention is to provide an apparatus which allows to obtain elongated articles with predetermined section profile by only one operation in which a metal sheet is cold bent.

Another object of the present invention is to obtain these elongated articles by an apparatus of limited dimension.

Still further object of the invention is to provide a bending apparatus, whose characteristic is versatility, which allows to rapidly and easily change the elongated articles being produced.

The above mentioned objects are obtained, in accordance with the invention, by an apparatus for cold bending of metal sheets to obtain elongated articles with predetermined section profile, said apparatus including: support means for supporting opposite ends of one sheet to be formed;

- a form which has a section shaped according to said predetermined profile and operated perpendicularly with respect to its longitudinal axis;
- a stop that faces said form, so that said form, while lowering, clamps said sheet piece to be formed and resting on said support means, to said stop;

- two plates oscillating on a vertical plane transversal to said form;
- two spindles fitted to said plates and arranged parallel to said form and at either sides of said stop;
- two bending members rotating about said spindles, said bending members being operated in time relation with a synchronous movement of said form and said stop, to fold the two ends of said sheet round said form.

BRIEF DESCRIPTION OF THE DRAWINGS

The characteristics of the invention are pointed out in the following description, with particular reference to the enclosed drawings, in which:

FIGS. 4*a*, 4*b* and 4*c* show the same laterat partial view of the apparatus in other working steps;

DESCRIPTION OF THE PREFERRED EMBODIMENT

Figure 1:
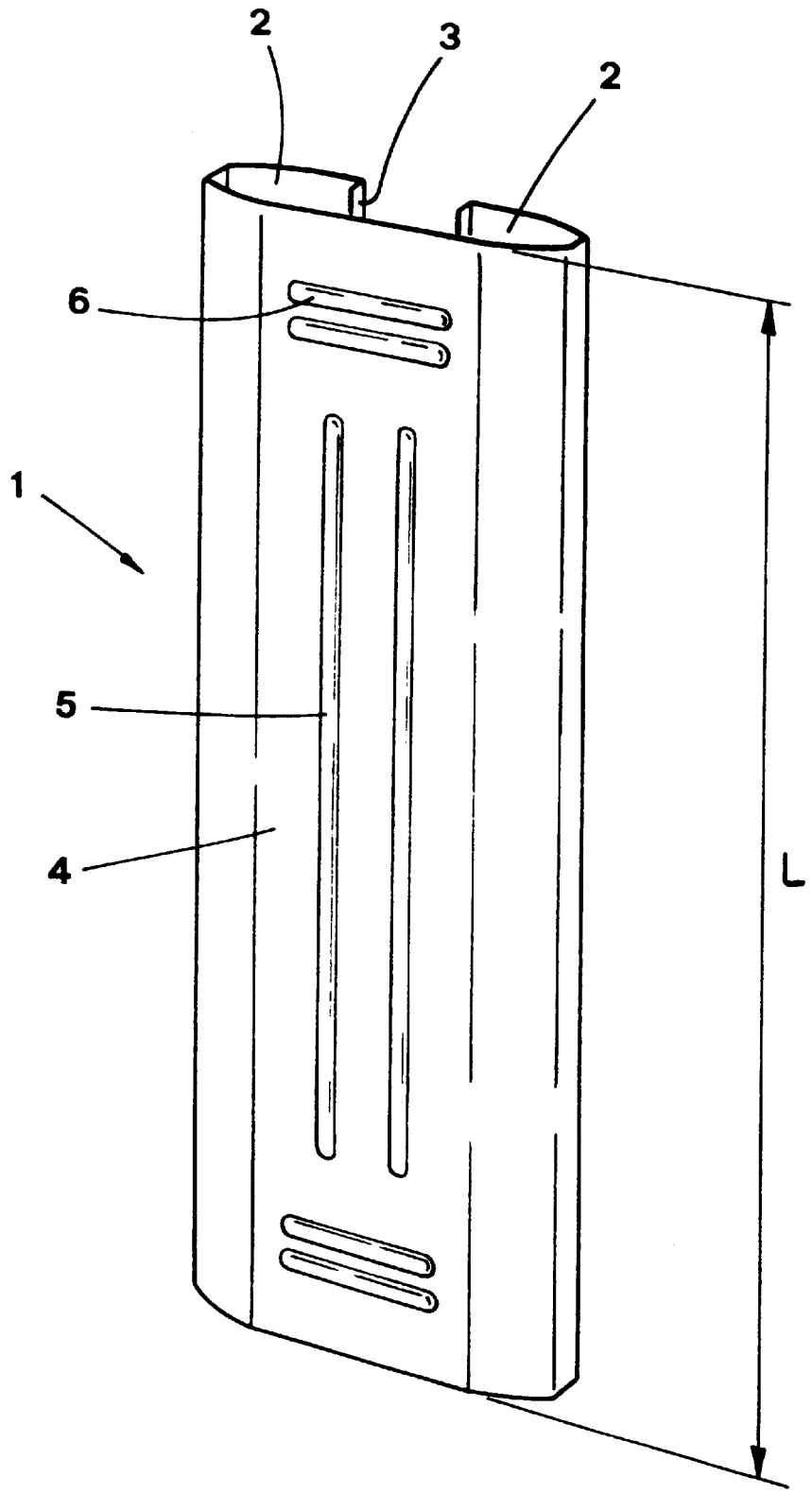
FIG. 1 is a perspective view of an elongated article produced by the apparatus being the subject of the invention.
Figure 2:
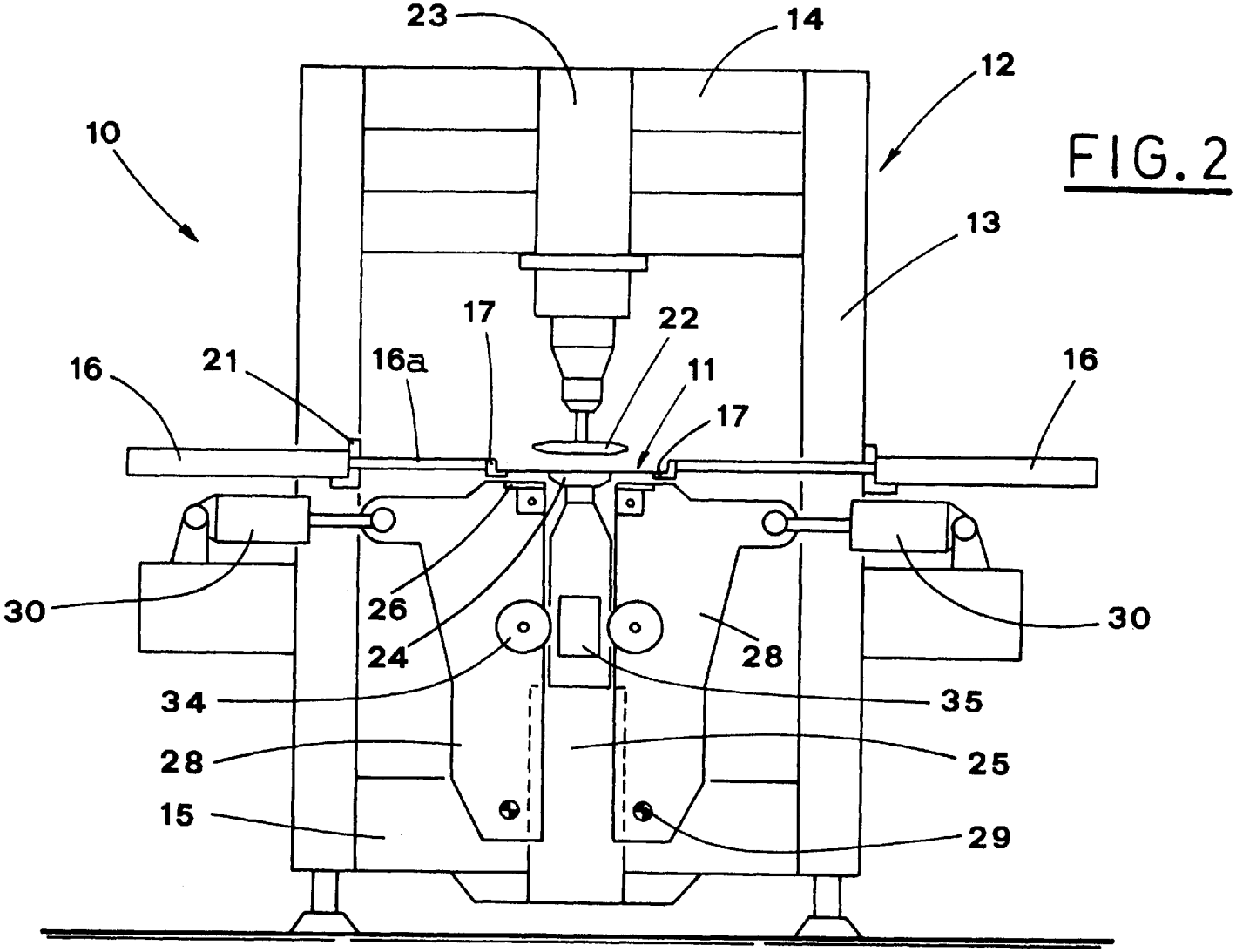
FIG. 2 is a schematic lateral view of the subject apparatus.

With reference to the above mentioned figures, the numeral 10 indicates the apparatus for cold bending of metal sheets 11 for obtaining elongated articles 1 with predetermined section profile.

The apparatus 10 includes a structure 12 equipped with uprights 13 connected by an upper cross-bar 14 and a lower cross-bar 15.

In their central part, the uprights 13 carry respective actuators 16, opposite to each other and aligned along a horizontal axis.

The stems 16*a* of these actuators 16 carry at their extremities relative elements 17 for supporting the opposite sides of the metal sheet 11 being bent, resting thereon.

These supporting elements 17 are substantially formed by squared and parallel angle bars, which are arranged horizontal and coplanar. The angle bars are provided, at one extremity, with suitable shoulders 18 acting as stops for the sheet 11.

Figure 5:
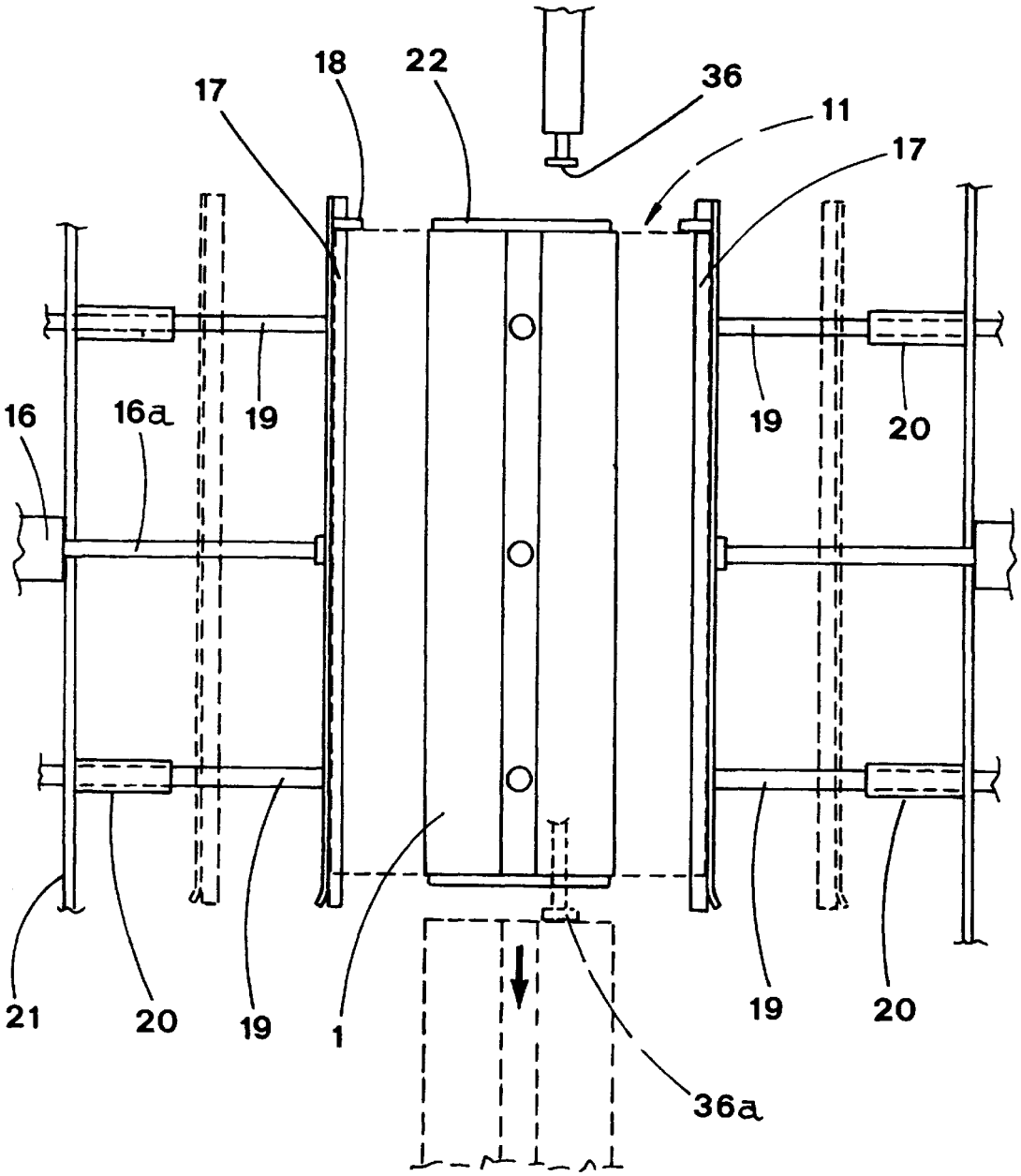
FIG. 5 is a corresponding partial plan schematic view of the apparatus.

Each of these angle bars is fastened to a pair of rods 19 which slide through relative sleeve, 20 carried by a bar 21, which is integral with the uprights 13 of the frame 12 (FIG. 5).

A form 22 having a section according to the predetermined profile of the articles to produce, is carried parallel and in median position with respect to the supporting angle bars 17, over the sheet 11 resting on the supporting angle bars 17.

The form 22 is operated vertically, perpendicularly with respect to its longitudinal axis, by a related actuator 23 carried by an upper cross-bar 14 of the frame.

The form 22 is removably fastened to the stem 23*a* of this actuator 23, so that it can be changed. The form 22 is aimed at clamping the sheet 11 being formed, resting on the supporting angle bars 17, to an opposite stop 24 formed by an elongated horizontal plate, parallel and located in a median position with respect to the angle bars 17.

The stop plate 24 is operated vertically by a related actuator 25 carried by a lower cross-bar 15 of the frame.

Also the stop plate 24 is removably fastened to the stem 25*a* of the actuator 25 so that it can be replaced.

The apparatus further includes a couple of plates 28 pivoted so that they can oscillate on a vertical plan transversal to the form 22. In their lower part, the plates 28 are pivoted on pins 29 fixed to the lower cross-bar 15 of the frame, and are operated synchronously, in opposite directions, by relative actuators 30 carried by the uprights 13.

Two spindles 27 are fitted to the plates 28 and are arranged parallel to the stop plate 24 at either side thereof. Respective bending members 26 are set to rotate around the spindles 27 and are parallel to the form 22 Also the bending members 26 are arranged at either side of the stop plate 24.

Figure 3A:
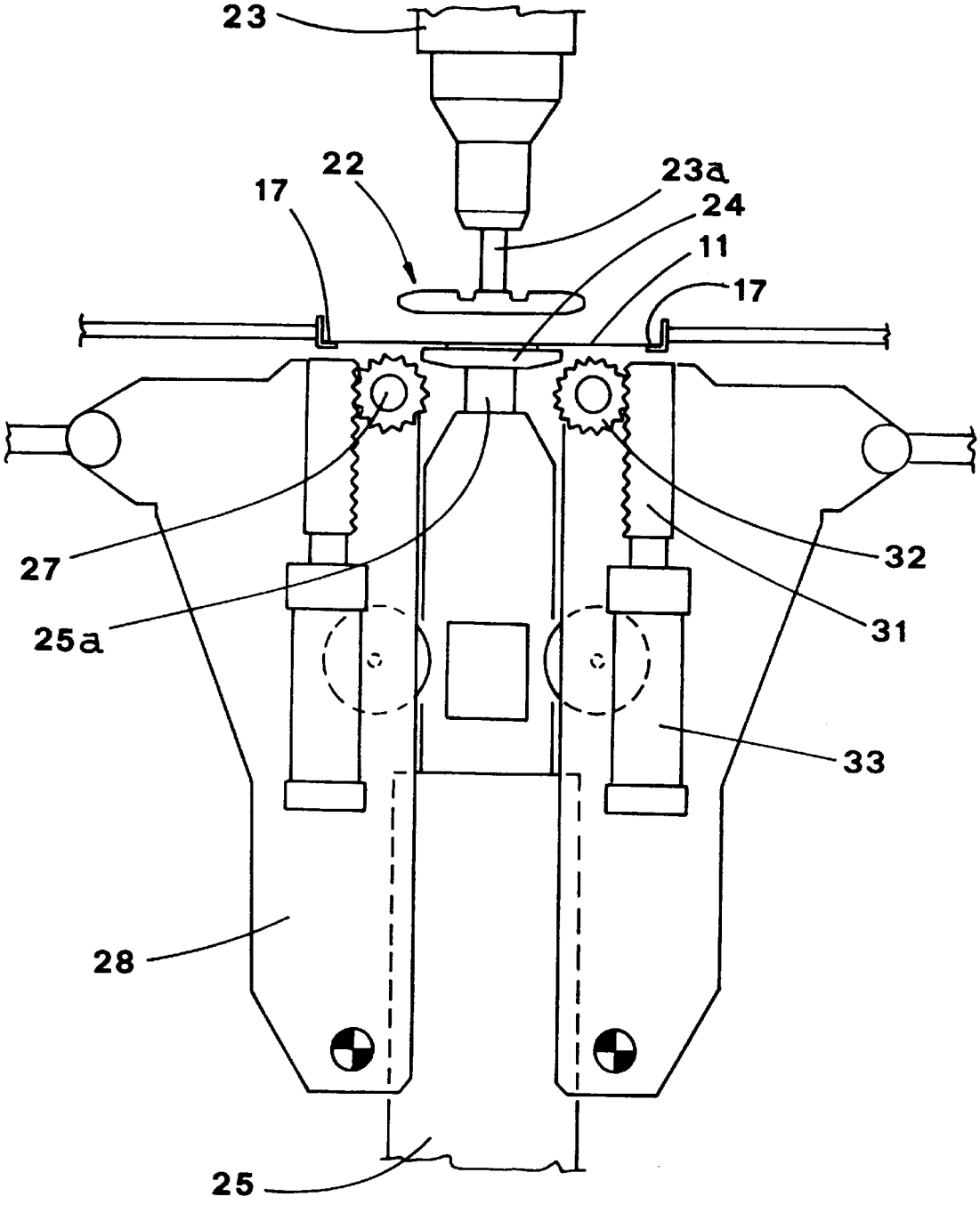
FIGS. 3*a* and 3*b* show an enlarged part of the above lateral view of the apparatus, in different, working steps.

The bending members 26 are formed by elongated plates, suitably shaped, and are driven into rotation by respective racks 31 engaged with relative pinions 32 integral with the spindles 27 (FIG. 3*a*). The racks 31 are operated by further actuators 33, that are carried respectively by the pates 28.

The plates 28 carry also respective rollers 34 that are brought to strike against opposite sides of a central shoulder 35 acting as a stop.

The apparatus includes also an extractor 36 acting along a direction longitudinal with respect to the form 22 so as to take out the already formed article 1 therefrom (FIG. 5).

Operation of the apparatus will be described beginning from the step in which a sheet 11 to be formed is put on the angle bars 17, as shown in FIG. 3*a*.

Figure 3B:
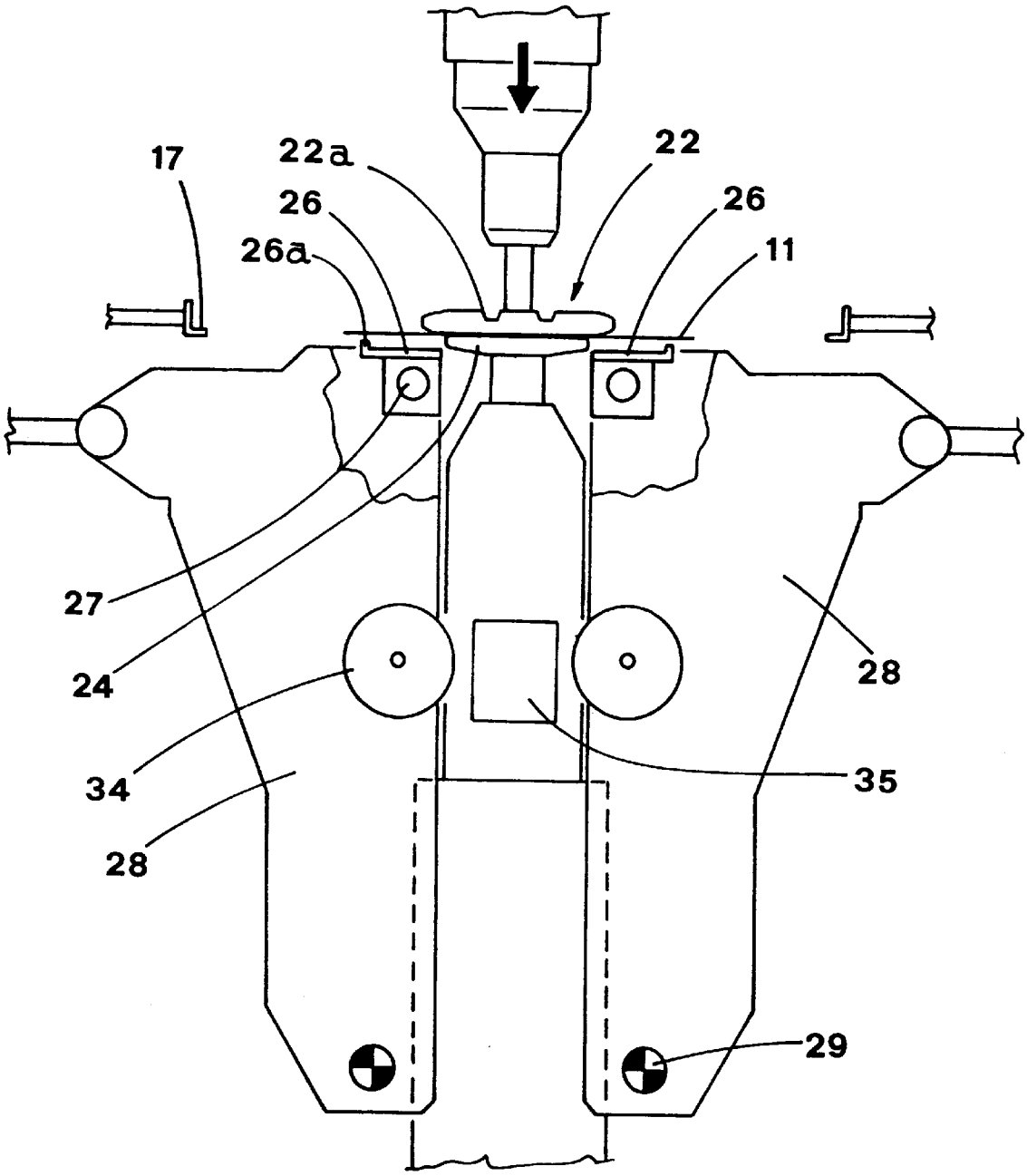

The form 22, operated vertically by its actuator 23, clamps the sheet 11 to the stop plate 24 (FIG. 3*b*).

The angle bars 17 are brought to a retracted position, in which they do not interfere with subsequent bending operations performed on the sheet 11.

Figure 4A:
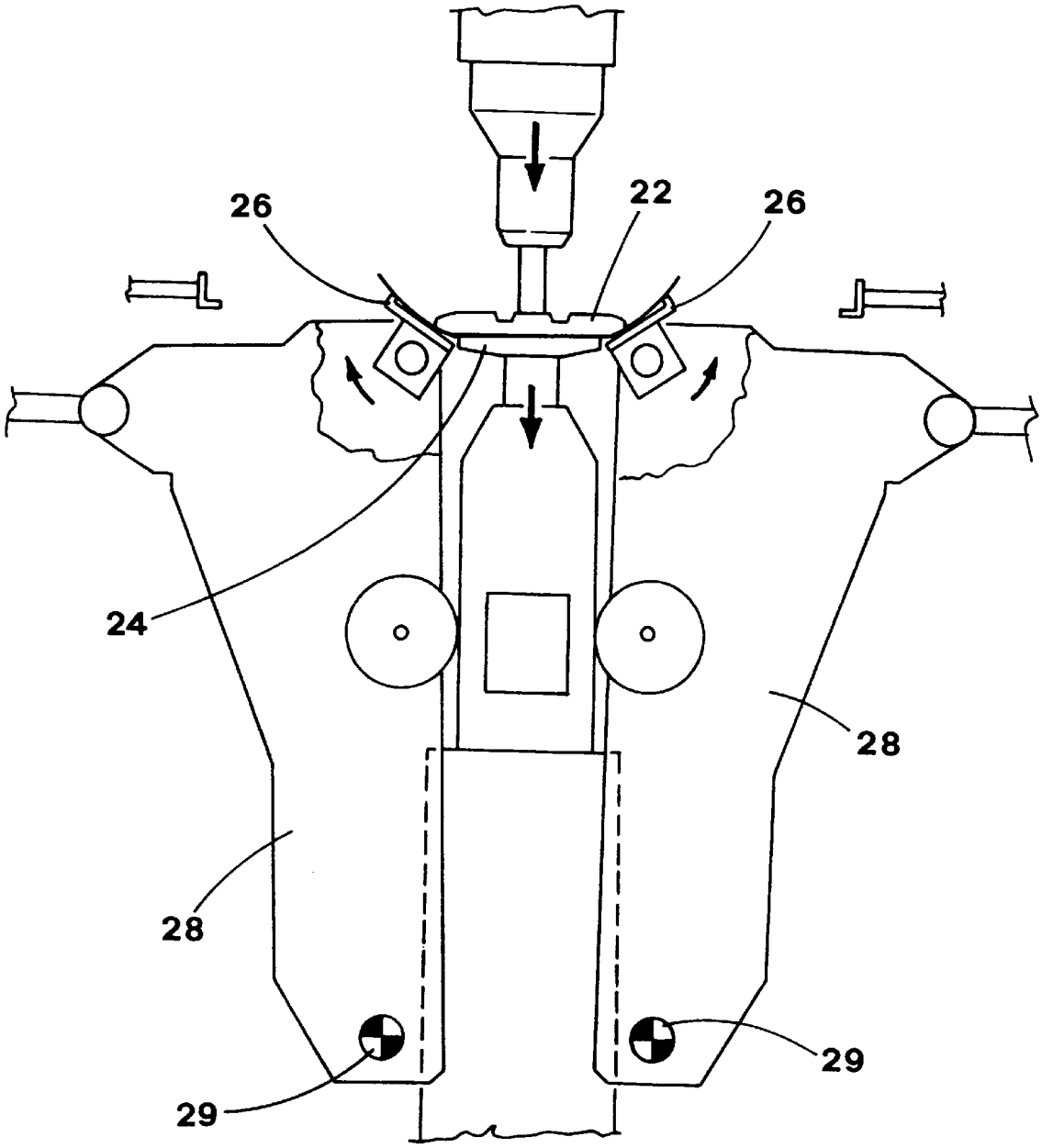

At this point, the bending plates 26, operated by the respective racks 31, are rotated in suitable time relation with oscillation of the plates 28. Meanwhile, the form 22 and of the stop plate 24 are operated by the respective actuators 23 and 25 (FIG. 4*a*).

The bending action of the bending members 26 together with the above mentioned movement of the form 22 make the two edges of the sheet 11 fold around the form 22 (FIG. 4*b*).

It is to be pointed out that the above mentioned combined rotation movements of the bending members 26, oscillation movements of the plates 28 and translation movements of the form 22, allow to further fold the sheet 11 around the form 22 without sliding. This is obtained because the bending members 26 "rotate" on the surface of the sheet 11.

In practice, these movements are suitably programmed in relation to the profile to be obtained.

When this folding step is finished, the sheet 11 is completely folded around the form 22 and assumes its shape (FIG. 4*c*).

It is to be pointed out that, in the illustrated case, the bending members 26 are provided with respective teeth 26*a*, arranged along their edges. The task of the teeth is that of introducing the longitudinal edges of the sheet 11 inside the grooves 22*a* made longitudinally in the form 22, so as to turn inwards the edges 3 of the elongated article 1.

Otherwise, these turned inward edges 3 can be made directly on the sheet 11 to be formed.

The so obtained article 2 is then extracted from the form 22 by operating the extractor 36, as indicated with the broken line 36*a* in FIG. 5.

Obviously, the size and shape of the form 22 are determined taking in consideration the spring back of the metallic sheet which occurs, when the bending operation is completed. This spring back is advantageous because it facilitates extraction of the already formed article 1 from the form 22.

Therefore, the apparatus fulfils the object of producing elongated articles with predetermined section profile by only one cold bending operation performed on the sheet which is already shaped in relation to the size of the articles to be obtained.

In particular, this operation allows to produce special relieves, such as the above mentioned ribs or the like. These relieves can have even complicated shapes.

One characteristic of the bending apparatus is that it allows to rapidly and easily change the kind of elongated articles being produced.

In order to perform this change, it is necessary to substitute the easily interchangeable form 22 and the elements connected thereto during the bending step.

Moreover, the apparatus is very small. In fact, its size corresponds to the length of the articles to be obtained.

What is claimed is:

1. An apparatus for cold bending a metal sheet to obtain an elongated article having a predetermined section profile, said apparatus comprising:

support means for supporting opposite ends of the sheet to be formed;

a form having a longitudinal axis and a section shaped according to said predetermined profile, said form operated perpendicularly with respect to the longitudinal axis;

a stop that faces said form, so that said form, when lowered, clamps said sheet resting on said support means to said stop;

two plates mounted for oscillation on a vertical plane transverse to said form;

two spindles fitted to said plates and arranged parallel to said form and located at either side of said stop plate;

two bending members rotatable about said spindles, means for driving said bending members in time relation with a synchronous movement of said form and said stop, such that the bending members fold the two ends of said sheet around said form.

2. The apparatus of claim 1 wherein said bending members are formed by elongated plates, suitably shaped, and situated on opposite sides of said form and said operating means are respective racks engaged with respective pinions integral with the spindles and moved by respective actuators carried by said plates.

3. An apparatus, according to claim 1, wherein said stop is formed by an elongated horizontal plate, arranged parallel and in median position with respect to said supporting elements, and operated vertically by a respective actuator.

4. An apparatus, according to claim 1, wherein said support elements are carried by respective actuators and arranged symmetrically on both sides of said form, said actuators retracting said support elements during bending.

5. An apparatus, according to claim 1, wherein said support elements are substantially formed by parallel, squared angle bars, arranged horizontal and coplanar, and provided, at one extremity, with shoulders acting as stops for the sheet to be formed.

6. An apparatus, according to claim 1, wherein said form is interchangeable and mounted to an actuator.

7. An apparatus, according to claim 1, wherein said plates are pivoted at bottom on pins and are operated synchronously, in opposite directions, by respective actuators.

* * * * *